US006892501B2

(12) United States Patent
Davis

(10) Patent No.: US 6,892,501 B2
(45) Date of Patent: May 17, 2005

(54) BLOCK WALL SYSTEMS

(75) Inventor: William John Davis, Stafford Heights (AU)

(73) Assignee: Smart Masonry (Holdings) Pty Ltd, Murarrie (AU)

( * ) Notice: Subject to any disclaimer, the term of this patent is extended or adjusted under 35 U.S.C. 154(b) by 3 days.

(21) Appl. No.: 10/270,688

(22) Filed: Oct. 16, 2002

(65) Prior Publication Data

US 2004/0000116 A1 Jan. 1, 2004

(30) Foreign Application Priority Data

Jul. 1, 2002 (AU) ..... PS3295

(51) Int. Cl.[7] ..... E04B 2/00

(52) U.S. Cl. ..... 52/586.2; 52/564; 52/281; 52/379

(58) Field of Search ..... 52/586.2, 564, 52/281, 379, 438, 590.1, 719; 403/381; 446/111, 112

(56) References Cited

U.S. PATENT DOCUMENTS

| | | | | |
|---|---|---|---|---|
| 510,720 A | * | 12/1893 | Stewart, Jr. | 52/279 |
| 3,640,039 A | * | 2/1972 | McKee et al. | 52/281 |
| 3,791,090 A | | 2/1974 | Kniefel | |
| 4,922,678 A | * | 5/1990 | Scheiwiller | 52/570 |
| 5,024,035 A | * | 6/1991 | Hanson et al. | 52/591.1 |
| 6,189,282 B1 | | 2/2001 | VanderWerf | |

FOREIGN PATENT DOCUMENTS

| | | |
|---|---|---|
| AU | 28440/67 | 4/1970 |
| AU | A-20487/92 | 1/1993 |
| GB | 1 534 501 | 12/1978 |
| WO | WO 83/00717 | 3/1983 |
| WO | WO 99/58783 | 11/1999 |

* cited by examiner

*Primary Examiner*—Naoko Slack
(74) *Attorney, Agent, or Firm*—Hoffman, Wasson & Gitler, PC

(57) ABSTRACT

An improved key for a dry wall block system is provided with a plurality of longitudinal flanges and a common web. The keys are adapted to engage with slots in the ends of building blocks to align and join the blocks and provide improved stability during the erection process.

21 Claims, 2 Drawing Sheets

BLOCK WALL SYSTEMS

TECHNICAL FIELD

Figure 1:
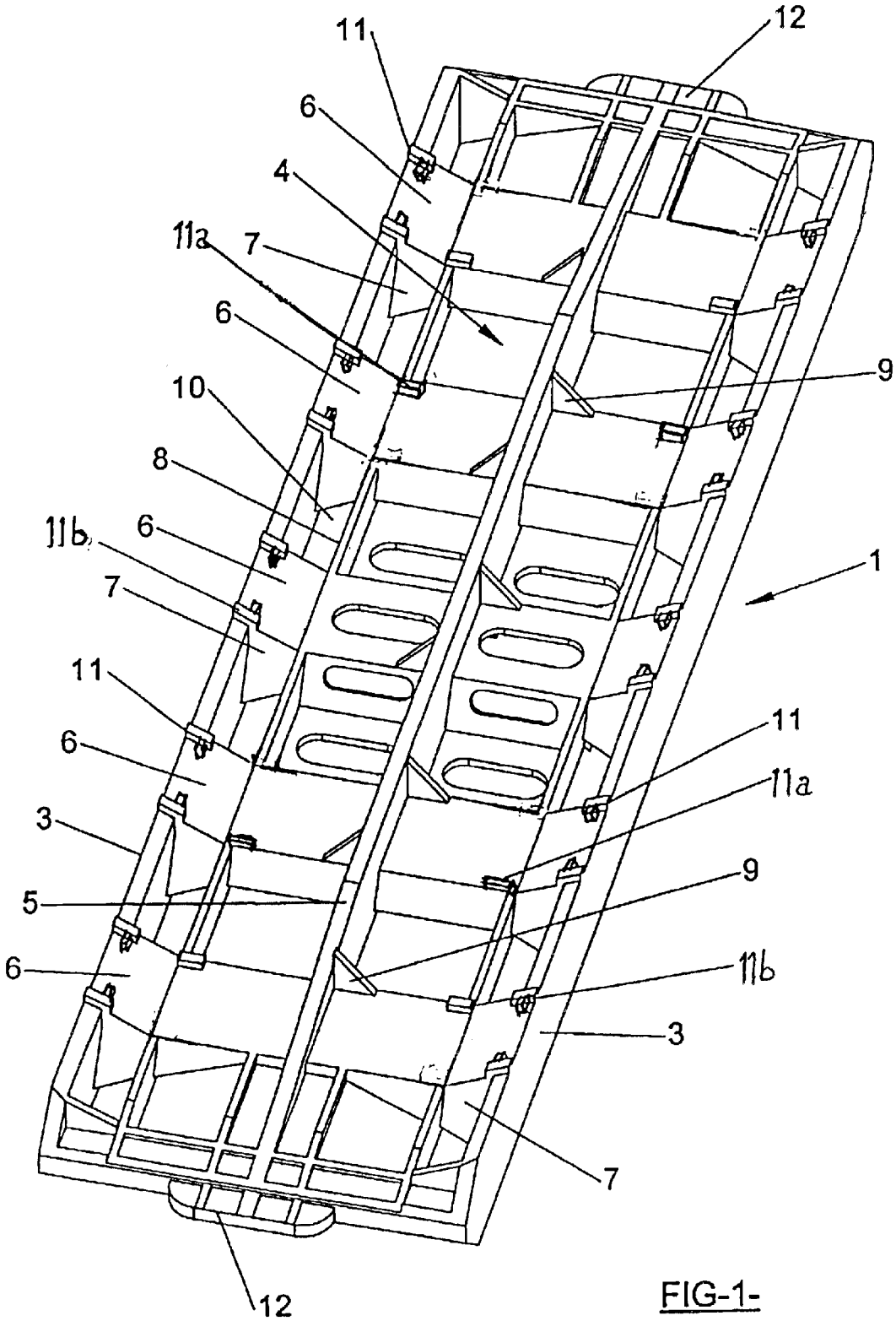

The present invention relates to block wall systems and in particular dry wall systems.

BACKGROUND ART

International patent application no. PCT/AU99/00348 describes a dry wall block system in which blocks are joined end to end by keys and cavities and passages within and between the blocks are then grouted.

Whilst the system described by International patent application no. PCT/AU99/00348 has many advantages in some instances a modified keying system will provide additional advantages particularly for semi-skilled layers, and further advantages relating to alignment and stability of a wall during construction.

Accordingly, it is an object of the present invention to provide a keying system for a block wall to further enhance ease of erection and to provide with improved stability and alignment during the construction phases.

Further objects and advantages of the present invention will become apparent from the ensuing description which is given by way of example only.

DISCLOSURE OF INVENTION

According to a first aspect of the present invention, there is provided an elongate key for engaging and aligning the ends of stacked building blocks, the key comprising:

(a) a substantially rectilinear body, (b) a pair of substantially parallel opposed outer flanges, (c) a common web between the flanges, and (d) a central flange between the outer flanges which extends from the common web and is substantially parallel to said outer flanges.

The common web can include ramps which slope from the outer flanges towards the centre of the key and towards central portions of the web which are substantially perpendicular to the outer flanges.

The central flange can be braced with respect to the portions of the common web.

The outer flanges can be provided with a plurality of spaced tab projections

Inner portions of the common web can be provided with a plurality of spaced tab projections.

The common web can be apertured to reduce the material content of the key.

The ends of the key can be provided with end projections.

The central flange can taper towards the ends of the key.

The profile of the common web between the flanges on the longitudinal axis of the key can be characterised by a series of alternating grooves and ridges.

According to a further aspect of the present invention, there is provided a block wall construction comprising a plurality of stacked cavity blocks having abutting ends joined by keys as aforesaid.

The wall can be reinforced by vertical and horizontal reinforcing bars.

Ends and intermediate walls of the blocks can be trough-shaped on their upper faces so that horizontal reinforcing bars can settle under their own weight at one or both sides of the keys.

According to a still further aspect of the present invention, there is provided an elongate key for engaging and aligning the ends of stacked building blocks, the key comprising:

(a) a substantially rectilinear body, (b) a pair of substantially parallel opposed outer flanges, (c) a common web between the flanges, wherein the common web includes ramps which slope from the outer flanges towards the centre of the key and towards central portions of the web which are substantially perpendicular to the outer flanges.

The key may incorporate the features of the key in accordance with the key of the first aspect of the invention.

Figure 2:
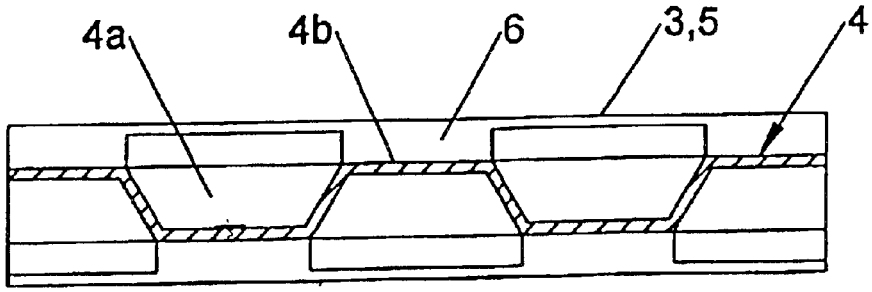
Figure 3:
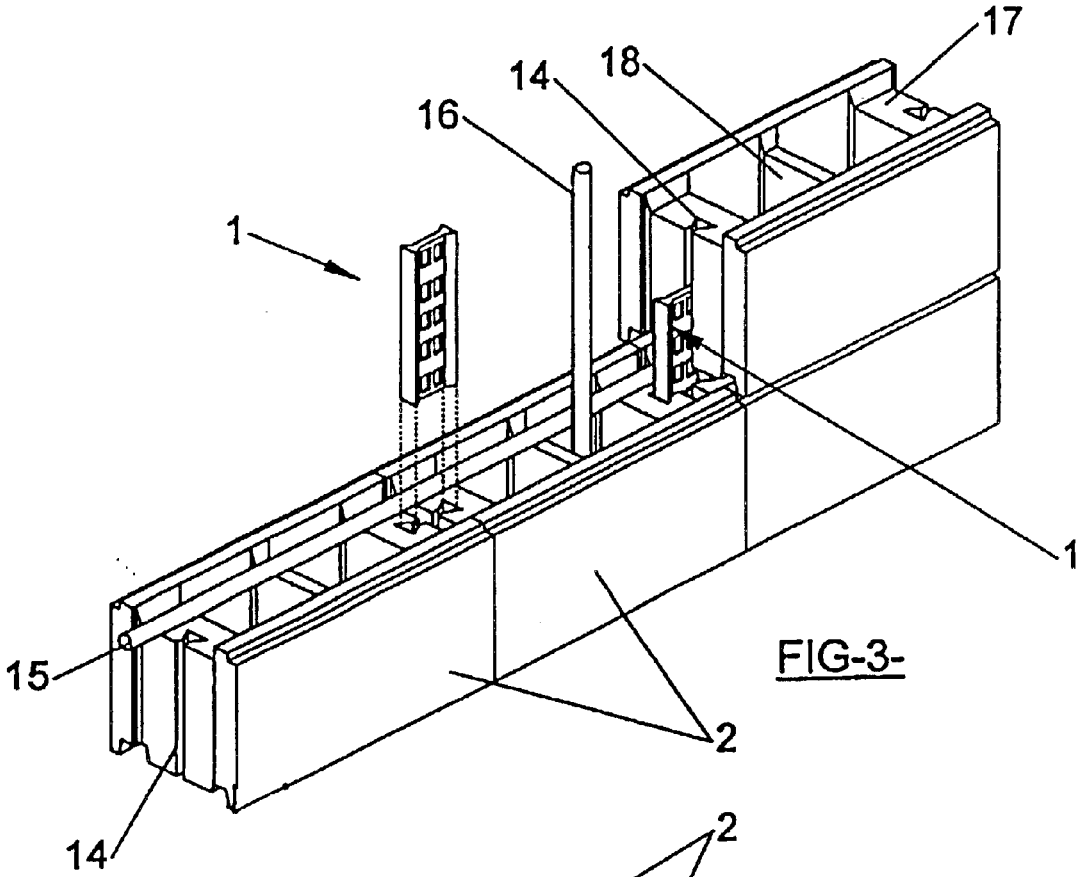
Figure 4:
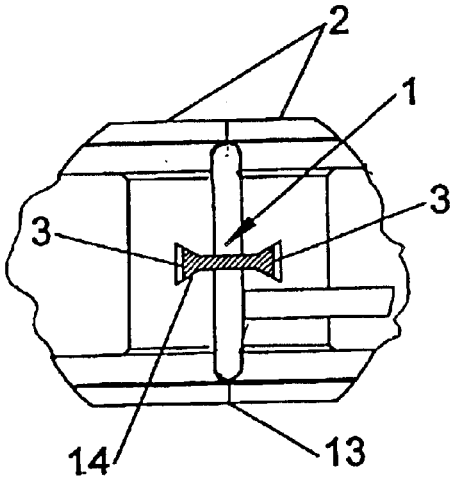

Aspects of the present invention will now be described with reference to the accompanying drawings, in which:

FIG. 1 is a perspective view of a key according to the present invention, and FIG. 2 is a sectional drawing taken on the longitudinal axis of the common web, and FIG. 3 is a perspective view of a block wall under construction utilising the keys of the present invention, and FIG. 4 is a diagrammatic sectional drawing of a key joining the end walls of blocks.

With respect to the drawings, according to one aspect of the present invention there is provided an elongate key generally indicated by arrow 1 for engaging and aligning the ends of stacked building blocks 2.

The keys 1 have a substantially rectilinear body, a pair of substantially parallel opposed outer flanges 3, a common web generally indicated by arrow 4 between the flanges, and includes a central flange 5 between the outer flanges 3.

The common web 4 may include ramps 6 which slope from the outer flanges towards the central longitudinal axis of the key and central portions 7 which are perpendicular to the outer flanges.

In the embodiment illustrated, the ramps 6 and central portions 7 are in rows.

Between the ramps 6 and central portions 7 strengthening ribs 8 are provided.

The central flange 5 can be braced with respect to the central portions 7 of the common web 4 by braces 9.

Spaces 10 between the ramps 6 and central portions 7 can be recessed and portions of the web towards the centre of the key may be apertured to reduce material content.

The outer flanges 3 and inward portions of the web 4 are provided with extending tabs 11.

Tabs 11*a* adjacent the outer flanges 3 are elongate and substantially rectilinear and tabs 11*b* positioned between the ramps 6 and central portions 7 are rectilinear and T-shaped as indicated by FIG. 1.

The ends of the key 1 can be provided with projections 12.

FIG. 2 of the drawings illustrates the profile of the common web and between the flanges 3, 5. The web 4 is characterised by the provision of alternating series of grooves 4*a* and ridges 4*b*. Such a profile provides resilience and strength whilst minimising material content.

FIG. 3 of the drawings illustrates a block wall under construction using the keys of the present invention.

A typical block wall construction comprises a base course (not shown) and stacked blocks 2 in multiple courses having abutting ends.

Keys 1 are inserted in keyslots 14 as indicated and horizontal and vertical reinforcing bars 15, 16 can be positioned as illustrated. The methodology used to erect a wall is fully described and documented in available technical literature which can be accessed via www.smartmasonry-.com.

Half depth keys are inserted in the keyslots 14 of adjacent blocks of an initial course and as courses of blocks are built up full length keys 1 are then inserted using a suitable impact tool. The keys 1 extend partially into keyslots 14 of the stacked rows of blocks.

FIG. 4 of the drawings is a diagrammatic sectional plan drawing showing a key 1 joining the end walls 13 of blocks 2.

The top surfaces of end and intermediate walls 17, 18 of the blocks can be trough-shaped so that horizontal reinforcing bars 15 can be set against the keys prior to grouting.

The keys 1 can be inserted in the keyslots 14 using an impact tool impacting on the projections 12 of the keys.

The tabs 11, 11*a* and 11*b* ensure that the keys 1 are positively engaged with the walls of the keyslots 14 in the blocks notwithstanding the fact that the keyslots may vary in size slightly from time to time as a result of wear in moulds used to manufacture the blocks.

Where a block is manufactured from a relatively new or reconditioned block, the tabs 11*a* and 11*b* will score the walls of the dovetail slot 14 as they are driven in. Where a block is manufactured from a relatively worn mould the tabs 11*a* and 11*b* will compensate for the wear and ensure the keys perform the required task of aligning the blocks.

As is illustrated by FIG. 4, the outer flanges 3 of the keys 1 may not fully take up the dovetail portion of the keyslots 14 however the geometry and profile of the keys ensure that the keys are tensioned when inserted in the keyslots.

There are a number of advantages of the present invention, including:

- A tension tie between blocks at the mid-thickness of the wall, which coupled with a compressive force between blocks near a face of the wall, provides the wall with a horizontal moment capacity.
- A shear key is provided to prevent adjacent blocks within a course translating horizontally out-of-plane of the wall.
- A tension tie is created to connect a wall to a return wall.
- The edge wedge flanges engage the keyways in the blocks and provide strength to permit the key lock to be hammered into position.
- The central web provides the tension connection between the outer flanges, hence adjacent blocks, and provides shear key to prevent adjacent blocks within a course from translating horizontally out-of-plane of the wall.
- The voids in the web reduce the volume of the key and align with voids in the block keyway.
- The central flange provides strength to permit the key to be hammered into position.
- Stiffeners increase the capacity of the central rib to resist loads due to hammering.
- The midheight portion of the key which is not tapered, provides a spacer to horizontal reinforcement, which when laid on alternate sides of the key provides space for vertical reinforcement to be located at the midthickness of the wall.
- End projections centralise the load due to hammering and end ribs strengthen the end of the key to resist this load.
- Tab projections ensure a tight fit for the key lock while allowing for dimension variations in the blocks and key lock.

The preferred material from which the key lock may be formed is re-cycled plastics. The form of the key permits the key to be manufactured by injection moulding with a mould which parts on the midthickness of the key, which corresponds with the wall midthickness.

Aspects of the present invention have been described by way of example only and modifications and additions thereto may be made without departing from the scope of the invention as defined in the appended claims.

What is claimed is:

1. An elongate key for engaging and aligning the ends of stacked cavity building blocks, the key comprising:

(a) a substantially rectilinear body, (b) a pair of substantially parallel opposed outer flanges, (c) a common web between the flanges, and (d) a central flange between the outer flanges which extends from the common web and is substantially parallel to said outer flanges and wherein the central flange is braced with respect to the portions of the common web.

2. An elongate key as claimed in claim 1 wherein the common web includes ramps which slope from the outer flanges towards the centre of the key and towards central portions of the web which are substantially perpendicular to the outer flanges.

3. An elongate key as claimed in claim 1 wherein the outer flanges are provided with a plurality of spaced tab projections.

4. An elongate key as claimed in claim 1 wherein inner portions of the common web are provided with a plurality of spaced tab projections.

5. An elongate key as claimed in claim 1 wherein the common web is apertured to reduce the material content of the key.

6. An elongate key as claimed in claim 1 wherein the ends of the key are provided with end projections.

7. An elongate key as claimed in claim 1 wherein the central flange tapers towards the ends of the key.

8. An elongate key as claimed in claim 1 wherein the profile of the common web on a longitudinal axis between the flanges is characterised by a series of alternating grooves and ridges.

9. A block wall construction comprising a plurality of stacked cavity blocks having abutting ends joined by keys each key comprising:

(a) a substantially rectilinear body, (b) a pair of substantially parallel opposed outer flanges, (c) a common web between the flanges, (d) a central flange between the outer flanges which extends from the common web and is substantially parallel to said outer flanges, and wherein the cavity blocks comprise end walls having a keyway for receiving said key wherein said keyway includes a channel for receiving the outer flange of the key and at least one end wall includes a recess for receiving the central flange of the key whereby the cavity blocks are positioned in abutment with the adjacent blocks.

10. The block wall construction of claim 9 reinforced by vertical and horizontal reinforcing bars.

11. The block wall construction of claim 9 wherein ends and intermediate walls of the blocks are trough-shaped on their upper faces so that horizontal reinforcing bars can settle under their own weight at one or both sides of the keys.

12. An elongate key for engaging and aligning the ends of stacked building blocks, the key comprising:

(a) a substantially rectilinear body, (b) a pair of substantially parallel opposed outer flanges, (c) a common web between the flanges, wherein the common web includes ramps which slope from the outer flanges towards the centre of the key and towards central portions of the web which are substantially perpendicular to the outer flanges wherein a central flange between the outer flanges extends from the common web and is substantially parallel to said outer flange and wherein the central flange is braced with respect to the portions of the common web.

13. An elongate key as claimed in claim 12 wherein the outer flanges are provided with a plurality of spaced tab projections.

14. An elongate key as claimed in claim 12 wherein inner portions of the common web are provided with a plurality of spaced tab projections.

15. An elongate key as claimed in claim 12 wherein the common web is apertured to reduce the material content of the key.

16. An elongate key as claimed in claim 12 wherein the ends of the key are provided with end projections.

17. An elongate key as claimed in claim 12 wherein the central flange tapers at the ends of the key.

18. An elongate key as claimed in claim 12 wherein the profile of the common web on a longitudinal axis between the flanges is characterised by a series of alternating grooves and ridges.

19. A block wall construction comprising a plurality of stacked cavity blocks having abutting ends joined by keys, each key comprising:

(a) a substantially rectilinear body, (b) a pair of substantially parallel opposed outer flanges, (c) a common web between the flanges, wherein the common web includes ramps which slope from the outer flanges towards the centre of the key and towards central portions of the web which are substantially perpendicular to the outer flanges wherein a central flange between the outer flanges extends from the common web and is substantially parallel to said outer flange and the outer flange is braced with respect to the portions of the common web, and wherein the cavity blocks comprise end walls having a keyway receiving said key wherein said keyway includes a channel for receiving the outer flange of the key and at least one end wall includes a recess for receiving the central flange of the key whereby the cavity blocks are positioned in abutment with the adjacent blocks.

20. The block wall construction of claim 19 reinforced by vertical and horizontal reinforcing bars.

21. The block wall construction of claim 19 wherein ends and intermediate walls of the blocks are trough-shaped on their upper faces so that horizontal reinforcing bars can settle under their own weight at one or both sides of the keys.

* * * * *